United States Patent [19]

Hutchison

[11] Patent Number: 5,012,997

[45] Date of Patent: May 7, 1991

[54] INFORMATION DISPLAY BRACKET FOR USE IN PEGBOARD DISPLAY SYSTEMS

[76] Inventor: V. James Hutchison, 1949 S. Robb Way, Lakewood, Colo. 80227

[21] Appl. No.: 377,524

[22] Filed: Jul. 10, 1989

[51] Int. Cl.[5] ..... E04G 3/08

[52] U.S. Cl. ..... 248/220.4; 211/59.1

[58] Field of Search ..... 248/220.4, 220.2, 220.3, 248/221.3, 222.1, 223.3, 221.1, 221.2; 211/54.1, 57.1, 59.1; 40/124.1, 658, 653, 622

[56] References Cited

U.S. PATENT DOCUMENTS

| | | | |
|---|---|---|---|
| 3,610,425 | 10/1971 | Madey . | |
| 3,912,084 | 10/1975 | Valiulis . | |
| 4,303,217 | 12/1981 | Garfinkle | 248/221.1 |
| 4,394,909 | 7/1983 | Valiulis et al. | 211/59.1 |
| 4,474,300 | 10/1984 | Entis . | |
| 4,665,639 | 5/1987 | Fast | 40/124.1 X |
| 4,703,570 | 11/1987 | Fast | 40/124.1 X |
| 4,750,698 | 6/1988 | Barnes | 211/59.1 X |
| 4,783,033 | 11/1988 | Valiulis | 248/220.4 |
| 4,850,557 | 7/1989 | Valiulis | 248/220.4 |

*Primary Examiner*—Ramon O. Ramirez

*Attorney, Agent, or Firm*—Timothy J. Martin

[57] ABSTRACT

Information display brackets provided to retrofit existing product support brackets in pegboard display systems. The basic information display bracket includes a mounting plate that is slideably received between the mounting base of the support bracket and a pegboard support. The positive support bracket has at least one prong that engages the pegboard support, and a product support arm that projects forwardly to receive items for display. The mounting plate has mounting structure that engages the prong. The information display bracket has a display arm projecting forwardly of the mounting plate to support an information display plate at its distal end. The mounting plate and mounting structure position the display arm in spaced relation above the product support arm of the support bracket. Spacers may be used to hold a lower portion of the mounting plate slightly away from the pegboard to provide a wedge effect, and the lower portion of the mounting plate may be split into a pair of wings. The mounting structure may snap fit onto the prong or prongs of the product support bracket's mounting base.

14 Claims, 4 Drawing Sheets

INFORMATION DISPLAY BRACKET FOR USE IN PEGBOARD DISPLAY SYSTEMS

FIELD OF THE INVENTION

The present invention relates generally to product display apparatus and specifically to display brackets which are used in pegboard display systems to display merchandise items. This invention is especially directed to an auxiliary information display bracket adapted to retrofit onto existing product display brackets whereby information, such as price, that is relevant to an item may be presented proximate the display of that item.

BACKGROUND OF THE INVENTION

One of the most common apparatus used to display products and other items for view are various pegboard display systems. In these display systems, an upright pegboard support provides a vertically oriented mounting surface upon which product display brackets are mounted. Typically, the pegboard support has a front surface forming a background for the product display, and the pegboard support has a matrix of uniformly spaced holes that can receive the product display brackets. These display brackets have a mounting base and one or more hook shaped prongs which extend rearwardly of the mounting base and which are spaced to engaged selected mounting holes in the matrix formed in the pegboard support. Since the prongs extend from the front surface of the pegboard support, through selected mounting holes to the rear surface of the pegboard support, the mounting base becomes securely retained on the front surface of the pegboard support. A product support arm is connected to the mounting base and extends forwardly of the mounting base to terminate at a free outer end. Products for display are racked onto the product support arm and are sequentially removed from the product support arm, for example, by customers. In this manner, a variety of products or items can be displayed with high density and in a pleasing and organized manner.

It is often the case that the user of these pegboard display systems desires to present information in conjunction with the product display. Usually, this information comprises the price of the product, but other information, such as inventory control information, descriptive material, product name and the like, is often appropriate for presentation in conjunction with the product display.

The value of displaying information in conjunction with a product has been well recognized in the past. To this end, unitary product support and information display brackets have constructed for use with pegboard systems. Examples of these unitary systems are described in the following list of patents:

| U.S. Pat. No. | Inventor | Issue Date |
|---|---|---|
| 3,245,547 | FELKAY | 12 Apr. 1966 |
| 3,645,485 | GOLD | 29 Feb. 1972 |
| 4,246,710 | MIXER | 27 Jan. 1981 |
| 4,286,764 | PFEIFER | 1 Sep. 1981 |
| 4,303,217 | GARFINKLE | 1 Dec. 1981 |
| 4,351,440 | THALENFELD | 28 Sep. 1982 |
| 4,405,051 | THALENFELD | 20 Sep. 1983 |
| 4,474,351 | THALENFELD | 2 Oct. 1984 |
| 4,520,978 | TAUB | 4 June 1985 |
| 4,540,093 | MERL ET AL | 10 Sep. 1985 |
| 4,674,721 | THALENFELD | 23 June 1987 |

-continued

| U.S. Pat. No. | Inventor | Issue Date |
|---|---|---|
| 4,750,698 | BARNES | 14 June 1988 |

While the above referenced patents are suitable to display both products and information correlated to the products, the complete replacement of product support brackets which do not have unitary information displays is costly, and it may be appreciated that an information display that is adapted to retrofit onto existing product only display brackets can be desirable. Indeed, there has, in the past, been some development of information displays which retrofit onto product only display brackets. Examples of retrofit price display elements are shown in the following list of patents:

| U.S. Pat. No. | Inventor | Issue Date |
|---|---|---|
| 4,463,510 | WINDISH | 7 Aug. 1984 |
| 4,525,944 | FAST | 2 July 1985 |
| 4,531,313 | FAST | 30 July 1985 |
| 4,583,308 | TAUB | 22 Apr. 1986 |
| 4,646,454 | FAST | 3 March 1987 |
| 4,665,639 | FAST | 19 May 1987 |
| 4,693,024 | FAST | 15 Sep. 1987 |
| 4,698,929 | FAST | 13 Oct. 1987 |
| 4,703,570 | FAST | 3 Nov. 1987 |

In each of the retrofit apparatus described in the patents listed above, a flexible strip has a mounting portion that is mounted between the front surface of the pegboard support and the mounting base of the product support bracket. The flexible strip then extends alongside and in contact with the product support arm to terminate, at a distal end, in a downturned display portion upon which information can be presented. A disadvantage of these apparatus, though, is that the flexible strip can often become dislodged so that it falls off of the product display arm to droop alongside the upright pegboard support. Not only does this dislodgment make the information display substantially useless, but also dislodgment causes the pegboard display system to appear messy and unattractive and can even interfere with the removal of product from the product support brackets.

Accordingly, there remains a need for an improved retrofit element which can be mounted on a pegboard support surface in conjunction with product-only display brackets and which can provide information correlated to a product that is supported on the bracket. There is a further need for such an information display bracket which does not interfere with the product support bracket and which presents a pleasing, neat display.

SUMMARY OF THE INVENTION

It is an object of the invention to provide a new and useful information display bracket which can retrofit onto existing product-only display brackets for pegboard display systems.

It is another object of the present invention to provide an information display bracket which is mounted and supported in conjunction with a product-only display bracket by engaging the product-only bracket.

Still another object of the present invention is to provide an information display bracket for use with a product-only display such that the information display surface on the information display bracket does not interfere with the product-only display bracket.

Yet another object of the present invention is to provide an information display bracket which may be retrofit onto an existing product-only display bracket without removing that product-only display bracket from the upright pegboard support, and without the need to remove products from the product display bracket.

It is still a further object of the present invention to provide an information display bracket that is inexpensive to produce by convenient manufacturing techniques and which readily retrofits onto existing product-only display brackets.

According to the present invention, then, an information display bracket is provided to be used in conjunction with pegboard display systems wherein an upright pegboard support has a mounting hole matrix and wherein product support brackets mounted to the upright pegboard support. These product support brackets include a mounting base, at least one prong adapted to extend through a selected mounting hole to fasten the product support bracket to the pegboard support and a product support arm connected to and projecting forwardly of the mounting base to terminate at a free outer end so the products may be slideably received or "racked" on the product support arm and displayed forwardly of the pegboard support when the product support bracket is fastened to the pegboard support.

The information display bracket, according to the present invention includes, in its broad form, a mounting plate having an upper portion and a lower portion, a display arm having a proximal end connected to the upper portion of the mounting plate so that the display arm projects forwardly of the mounting plate to a distal end, and an information display plate connected to the distal end of the display arm. The lower portion of the mounting plate of this information display bracket has a thickness which permits the lower portion to be interposed between the mounting base and the front surface of the pegboard support when the product support bracket is fastened thereon. The mounting plate has an engagement structure for engaging one or more of the prongs which extend rearwardly of the mounting base of the product support bracket so that the mounting plate of the information display bracket is positively supported by and positioned with respect to the product support bracket with the display arm of the information display bracket oriented in a spaced relation above the product support arm along the length thereof.

Preferably, the display arm of the information display bracket has a length sufficient to position the information display plate forwardly of the outer end of the product support arm. Further, in the preferred embodiment, the distance between the distal end of the display arm and the product support arm is greater than the vertical length of the display plate between a lower edge thereof and its point of attachment to the distal end of the display arm; thus, the display plate does not to interfere with racking or removal of products from the product support arm. The display arm and the product support arm may be substantially parallel to one another when the product support bracket and the information display bracket are mounted on the pegboard support surface. Preferably, the information display bracket is formed as an integral one-piece construction of plastic material, and the mounting plate includes spacers which rearwardly extend from the lower portion of the mounting plate to bear against the front surface of the pegboard support thus causing the mounting plate to form an inclined plane or wedge with respect to the front surface of the pegboard support thereby increasing frictional engagement of the mounting plate between the mounting base and the pegboard support.

In one form of the invention, the information display bracket is adapted to be used with product support brackets that have a pair of horizontal spaced prongs. Here, the engagement structure is defined by a pair of outwardly disposed shoulders positioned to rest on the prongs. The side edges of the mounting plate may then be convergent to facilitate insertion of the mounting plate between the pair of horizontal prongs and, if desired, a plurality of pairs of shoulders may be formed in vertical spaced relation from one another whereby the spacing between the product support arm and the display arm may be selectively varied. In this construction, a longitudinal slot may be formed generally perpendicular to the line defined by each pair of outwardly disposed shoulders so that the lower portion of the mounting plate is separated by the slot into a pair of wings. The shoulders may then be formed by a arcuate portion of a semi-circular cutout region on the outer side edges of a respective wing so that the cutout regions may releasably lock onto the prongs when the shoulders engage the prongs. The cutout regions may be released by forcing the wings together to disengage the cutout regions. This slot may also be sized to accommodate a vertically extending rod portion where the product display bracket includes such a rod portion as part of its mounting base.

Where the mounting base of the product support bracket has either a single mounting prong or a pair of vertically spaced prongs, a longitudinal slot formed in the mounting plate maybe sized to slideably receive the prongs. In such construction, the slot terminates an inner arcuate edge and the engagement structure is defined by that inner arcuate edge of the slot. This inner arcuate edge may be a portion of a semi-circular cutout region sized to receive the uppermost one of the prongs, and the slot may have a slot width smaller than the width of the prong whereby the cutout region releasably locks onto the prong when the cutout regions engage the prong. The mounting base may be released from engagement with the prong by separating the wings formed by the slot. A plurality of semi-circular cutout regions may be spaced vertically from one another along the slot to again provide vertical adjustment of position.

These and other objects of the present invention will become more readily appreciated and understood from a consideration of the following detailed description of the preferred embodiment when taken together with the accompanying drawings, in which:

DETAILED DESCRIPTION OF THE PREFERRED EMBODIMENT

The present invention relates to pegboard display system and particularly to information display brackets which may retrofit onto existing product support brackets of the type mounted on an upright pegboard support in order to display products, items, and merchandise, especially as used in the retail sales field.

Figure 1:
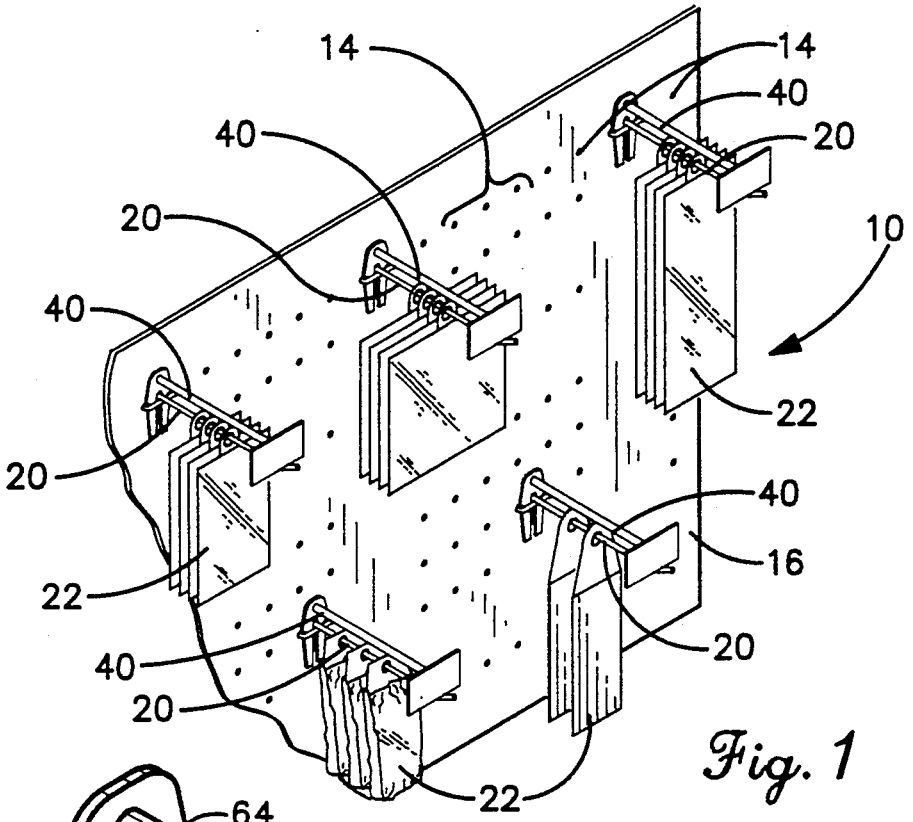
FIG. 1 is a perspective view of a pegboard display system showing a pegboard support, product support bracket, and the information display bracket according to the present invention.
Figure 2:
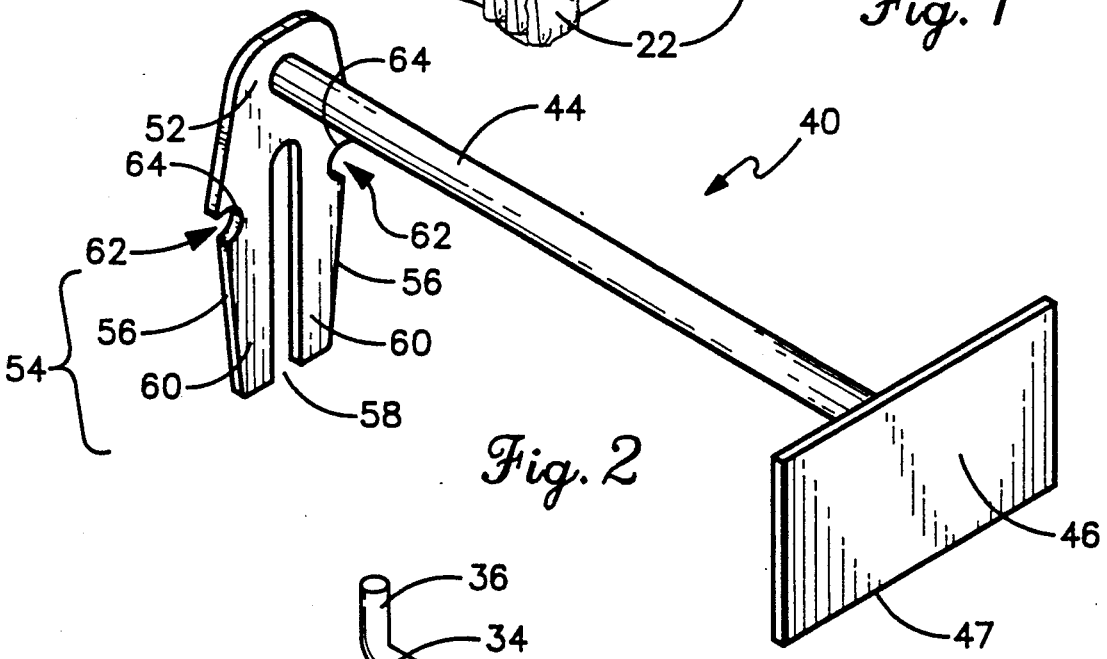
FIG. 2 is a perspective view of the information display bracket according to a first embodiment of the present invention.
Figure 3:
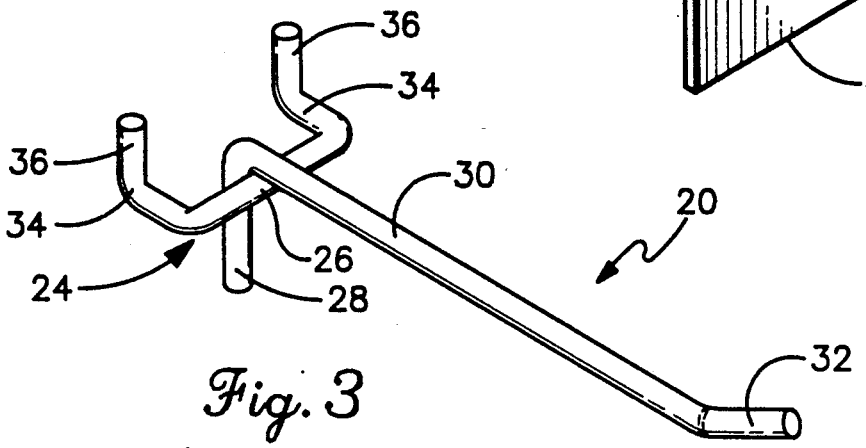
Fig. 3 (PRIOR ART)
FIG. 3 is a perspective view of a prior art product support bracket for use with a pegboard support and with which the first embodiment of the present invention cooperates.

Generally, pegboard display systems are well known and comprise an upright pegboard support to which product display brackets are releasably secured by means of mounting prongs. For purpose of reference, a representative pegboard system as shown in FIG. 1 which incorporates the information display brackets according to the present invention. As shown in FIG. 1, a pegboard display 10 has an upright pegboard support 12 that is provided with a uniform matrix of holes 14 which extend through the front surface 16 thereof. A plurality of product support brackets 20 are mounted in selected holes 14 on pegboard support 12 and are operative to support, for example, packaged items 22 forwardly of front surface 16. A plurality of information display brackets 40 according to the present invention are also provided to display information correlated to packaged items 22, such as price information, inventory information, descriptive information and the like. The information display bracket 40 according to the preferred embodiment of the present invention is best shown in FIG. 2 while the product support bracket 20 with which information display bracket 40 is employed is best shown in FIG. 3. The mounting of these brackets, 20 and 40, may be best seen with reference to FIGS. 4 and 5.

Figure 4:
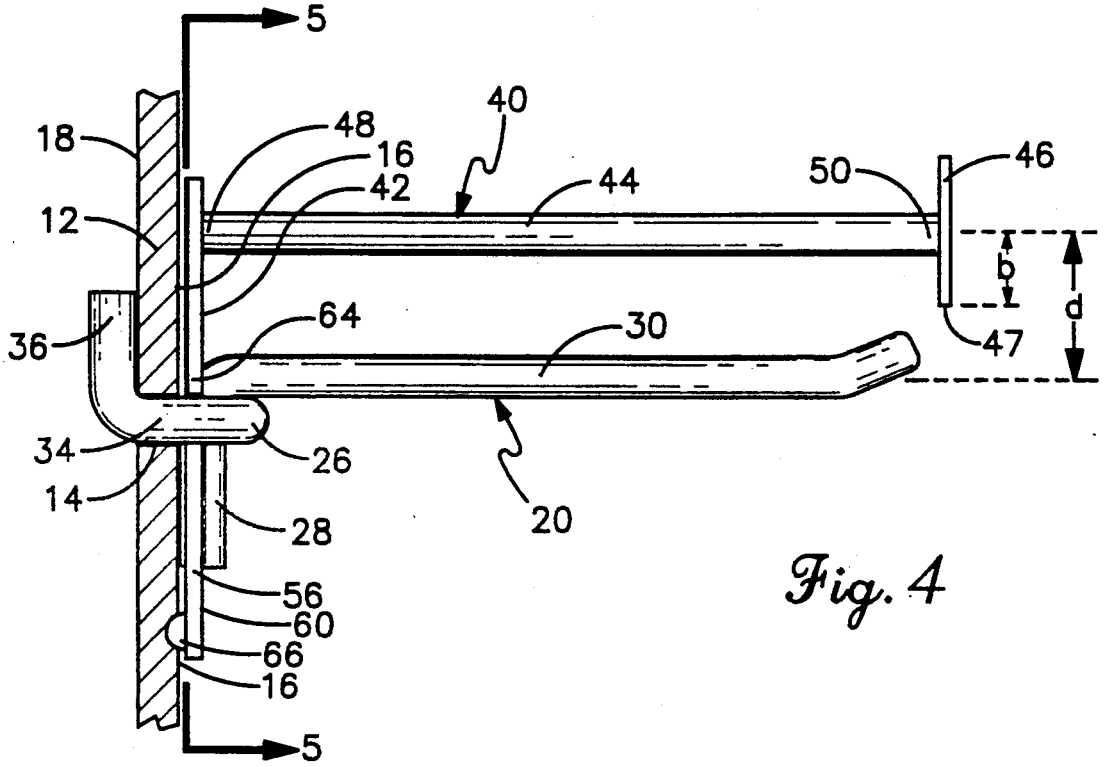
FIG. 4 is a side view in partial cross-section showing the mounting of the product display bracket of FIG. 3 and the information display bracket of FIG. 2 on a pegboard support.

Turning to FIGS. 2-5, then, it may be seen that the prior art product support bracket 20 includes a mounting base structure 24 which, in this prior art bracket, includes a cross-piece 26 and a downwardly depending rod portion 28 to which cross-piece 26 is welded or otherwise attached. A product support arm 30 extends forwardly of mounting base 24 and is formed as an integral piece of rod with rod portion 28. Thus, rod portion 28 and product arm 30 are formed by a single, L-shaped rod. Arm 30 terminates at a free outer end and 32 formed as an upturned end portion. A pair of mounting prongs 34 are formed as integral extensions of cross-piece 24 so that prongs 34 and cross-piece 24 form a generally U-shaped member having upturned ends 36. Prongs 34 are spaced apart a distance equal to the distance of spacing between holes 14 of the selected pegboard support so that ends 36 may be inserted through a horizontal pair respective selected holes 14 so that the pegboard support 12 is trapped between prongs 34 and rod portion 28 of mounting base 24, as is generally shown in FIG. 4.

As is often the case, a user desires to display information correlated to a product supported by bracket 20 in conjunction with the product. Where product support brackets 30 are employed, information display bracket 40 may be utilized and mounted on pegboard support 12 between mounting base 24 and front surface 16. As is shown in FIG. 2, the preferred information display bracket 40 includes a mounting plate 42, a display arm 44, and an information display plate 46. Preferably, information display bracket 40 is formed of an integral one-piece plastic construction, such as by injection molding and the like, so that a proximal end 48 of display arm 44 is connected to mounting plate 42 while distal end 50 of display arm 44 is connected to information display plate 46. Mounting plate 42 of information display bracket 40 has an upper portion 52 and a lower portion 54 with lower portion 54 having opposite side edges 56. Lower portion 54 is longitudinally split by means of a slot 58 so that a pair of parallel wings 60 are formed. Further, semi-circular cutout regions 62 are formed alongside edges 56 with cutout regions 62 being horizontally spaced from one another a distance equal to the distance between prongs 34 of product support arm 30 and thus the distance between selected mounting holes 14. Cutout regions 62 define a pair of outwardly disposed shoulders 64 which, as described more thoroughly below, are positioned to rest on and engage prongs 34. Information display plate 46 has a bottom edge 47 and the location of attachment of distal end 50 of display arm 44 to plate 46 is spaced a distance "h" above edge 47.

Figure 5:
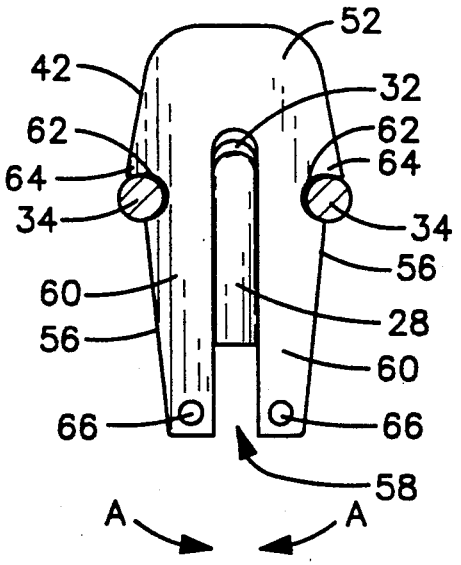
FIG. 5 is an end view in elevation taken about lines 5—5 of FIG. 4.

The mounting of product support bracket 20 and information display bracket 40 can now be more readily understood and appreciated with reference to FIGS. 4 and 5. Here, it may be seen that product support bracket 20 is first mounted to pegboard support 12 by extending prongs 34 through holes 14 so that upturned ends 36 are proximate rear surface 18 of pegboard support 12 with rod portion 28 bearing against front surface 16 of pegboard support 12. Lower portion 54 has a thickness that permits wing portions 60 of lower portion 54 of mounting plate 42 to be interposed between cross-piece 26 and the front surface 16 of pegboard support 12 until shoulders 64 rest on mounting prongs 34. Slot 58 is sized to slideably receive the vertically extending rod portion 28 so that rod portion 28 does not interfere with the interposition of mounting plate 42.

In order to further secure mounting plate 42, each wing portion 60 has a rearwardly projecting spacer nub 66 of any suitable configuration so that nubs 66 bear against front surface 16 of pegboard support 12 to bias with portions 60 away from front surface 16. Thus, mounting plate 42 defines an inclined plane with respect to the front surface of pegboard support 12, as is best shown in FIG. 4. In addition, cutout regions 62 are formed to releasably lock onto prongs 34 in a "snap-fit" manner. This locking action can be released by slightly deflecting wings 60 together in a direction of arrows A, shown in FIG. 5.

When mounted onto pegboard support 12, as shown in FIG. 4, display arm 44 is generally parallel to and spaced apart from product support arm 30 along the entire length thereof. Display plate 46, as noted above, has a point of attachment to the distal end of display arm a distance "h" above lower edge 47, and the attachment of proximal end 48 to mounting plate 42 is selected with respect to shoulder 64 so that the distance "d" of spacing between display arm 44 and product support arm 30 is greater than the distance "h". Thus, lower edge 47 is positioned above product support arm 30 when information display bracket 40 is secured to pegboard support 12. Furthermore, it is desirable that display arm 44 have a length that is longer than the length of product support arm 30 so that information display plate 46 is positioned forwardly of outer end 32 of product support bracket 20. This facilitate racking and removal of products from product support arm 30.

From the foregoing, it should readily be seen that information display bracket 40 provides a highly useful retrofit for existing pegboard display systems. Rather than incurring the cost of replacing all of the product support brackets with combination information/support brackets, the present invention simply, retrofits each product support bracket 20 with an information display bracket 40. To this end, it is not even necessary to remove merchandise or products from product support arm 30 during retrofit since mounting plate 42 can be inserted behind mounting base 24 of product support bracket 20 while products are in place on product support arm 30. By injection molding information display brackets 40 out of plastic material, it is further a simple matter to provide a variety of colors to create a more aesthetically pleasing display and to provide suitable rigidity of the information display arm 42 so that the pegboard display remains neat and organized.

Figure 6:
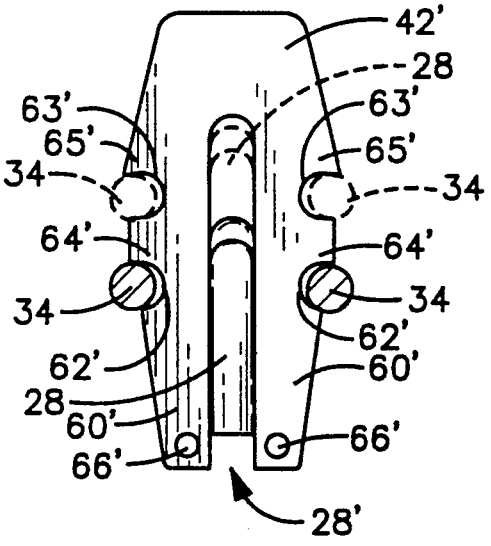
FIG. 6 is an end view in elevation, similar to FIG. 5, showing an alternate embodiment of the mounting base for use with the information display bracket of FIG. 2.

If desired, an alternate mounting plate 42' may be provided, as shown in FIG. 6. Here, wings 60' and slot 28' are extended so that a first pair of cutout regions 62' are provided to form shoulders 64' and a second pair of cutout regions 63' are provided to form a second pair of shoulders 65'. Use of this alternate mounting plate structure is the same as that described with respect to the preferred embodiment except that the distance "d" between product support arm 30 and the display arm 44 may be selectively adjusted by selecting which pair of cutout regions 62', 63' are utilized to engage prongs 34, as should be readily apparent to one ordinarily skilled in the art.

Figure 7:
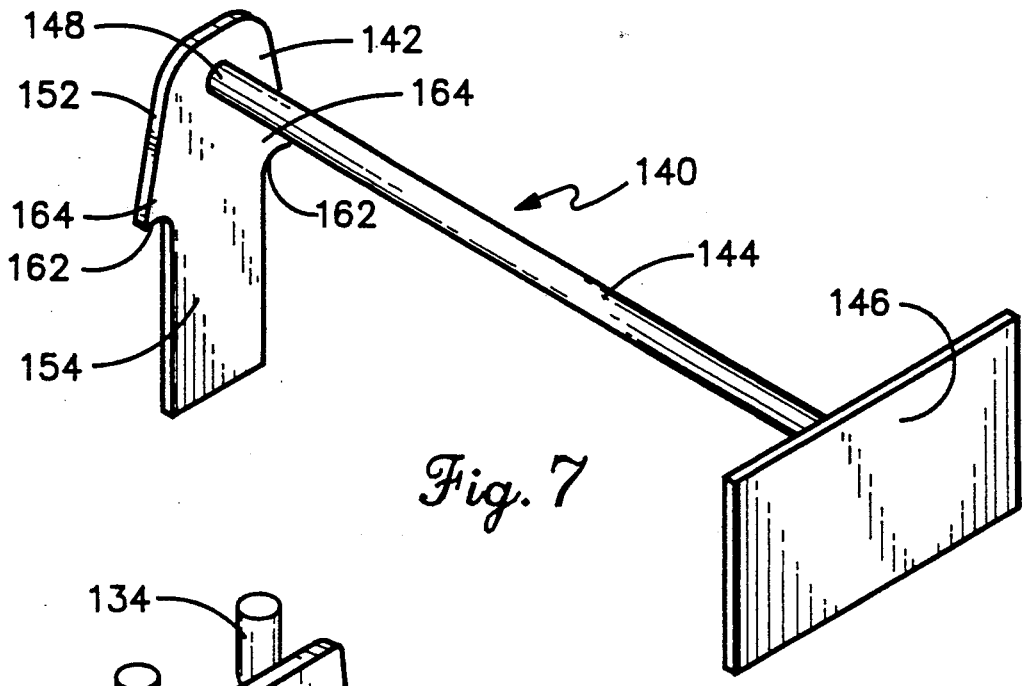
FIG. 7 is a perspective view of a second embodiment of the information display bracket of the present invention.
Figure 8:
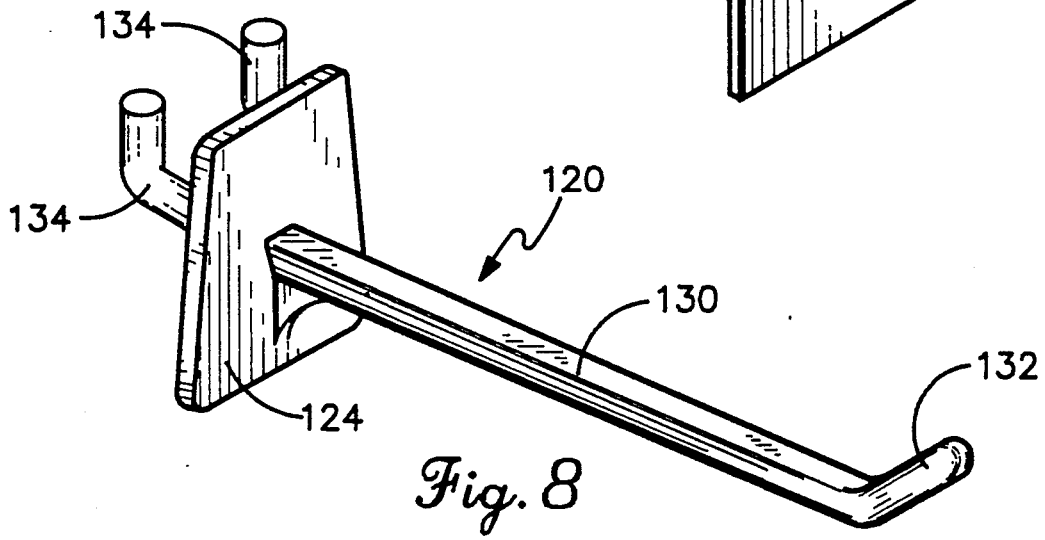
Fig. 8 (PRIOR ART)
FIG. 8 is a perspective view of a prior art product display bracket for use with the information display bracket shown in FIG. 7.
Figure 9:
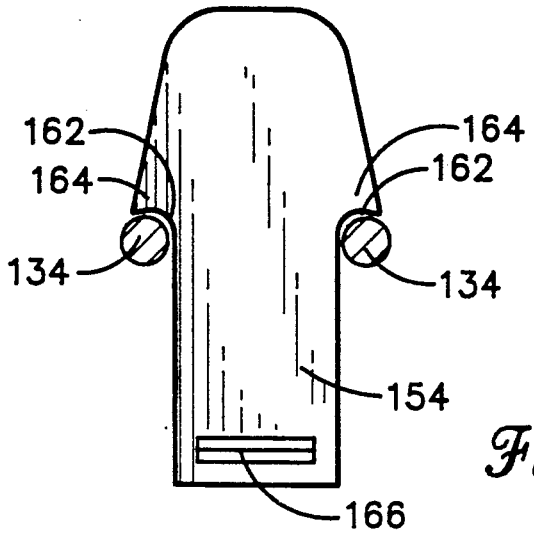
FIG. 9 is an end view in elevation showing the mounting plate of the information display bracket of FIG. 7 mounted on the product support bracket of FIG. 8.

FIGS. 7 and 9 show a second embodiment of an information display bracket with this bracket to be used in cooperation with a different product support bracket as shown in FIG. 8. As is shown in FIGS. 7–9, then, a product support bracket 120 is provided and is formed by a mounting base 124 from which a product support arm 130 projects outwardly to terminate at an outer end 132. A pair of mounting prongs 134 extend rearwardly of mounting base 124 and are hook-shaped so as to engage mounting holes in an upright pegboard support. Information display bracket 140 has a mounting plate 142 which includes an upper portion 152 and a lower portion 154 which is reduced in width so as to define a tongue having a pair of arcuate edges or cutouts 162 that define shoulders 164. Lower tongue shaped portion 154 is sized to snugly fit between prongs 134 so that shoulders 164 engage an rest on prongs 134, as is shown in FIG. 9. A spacer block 166 is provided again to provide a wedging effect when lower portion 154 of mounting plate 142 is inserted between a pegboard support and mounting base 124. A display arm 144 projects forwardly of mounting plate 142 from a proximal end 148 to a distal end to which is mounted an information display plate 146, much in the manner described with respect to the first embodiment discussed above. As can be seen in FIGS. 7–9, slot 58 is eliminated since there is no need to accommodate a rod portion 28 of the mounting base since mounting base 124 is formed as a flat piece of plastic material. However, if desired, a slot can be provided so as to allow some deflectability of the resultant wings to help engage and disengage semi-circular cutout regions 162, if desired.

Figure 10:
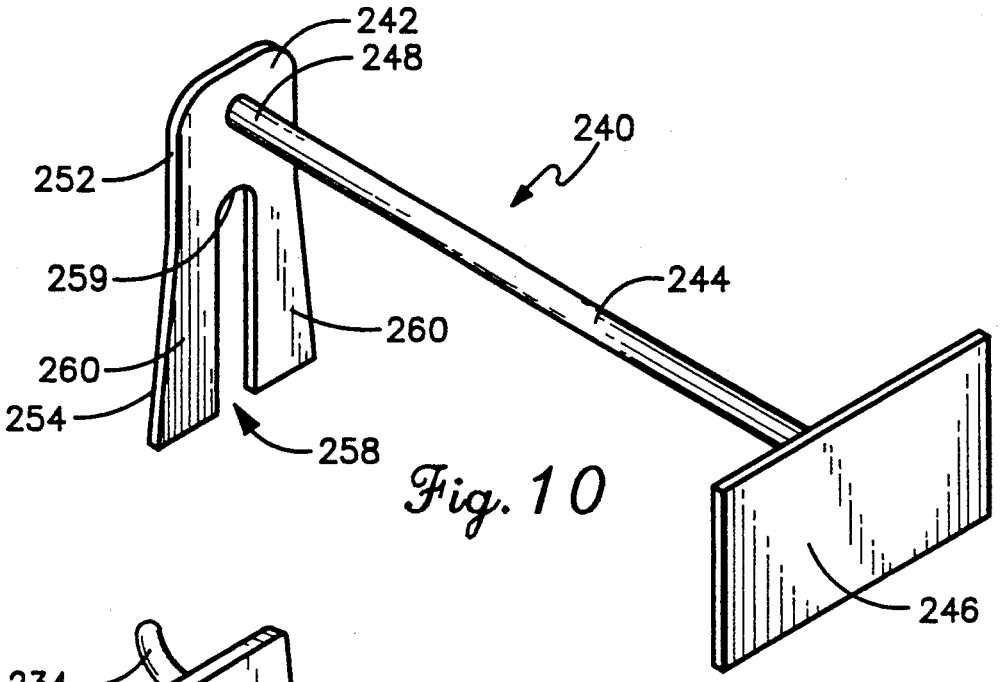
FIG. 10 is a perspective view of a third embodiment of the information display bracket according to the present invention.
Figure 11:
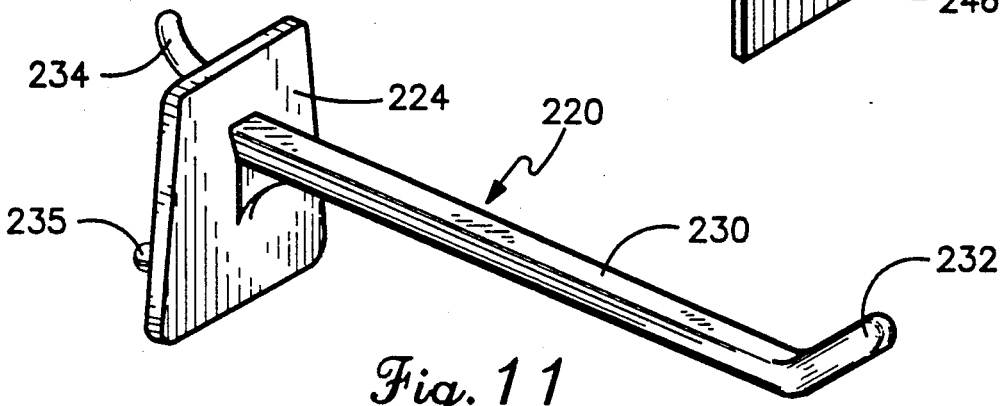
Fig. 11 (PRIOR ART)
FIG. 11 is a perspective view of a prior art product support bracket for use with the information display bracket shown in FIG. 10.
Figure 12:
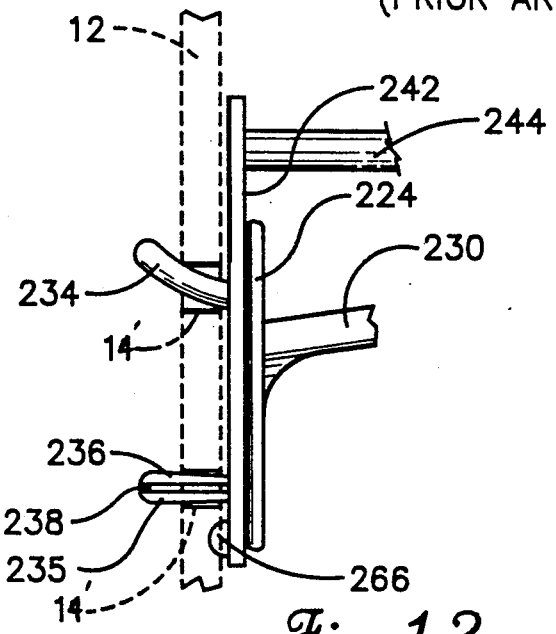
FIG. 12 is a side view showing the mounting of the information display bracket and the product support bracket of FIGS. 10 and 11 on a pegboard display; and, FIG. 13 is an end view in elevation showing an alternate embodiment of the mounting plate for use with the display bracket shown in FIG. 10.

Yet another embodiment of the present invention is shown in FIGS. 10–12. Here, a product support bracket 220 has a flat mounting base 224 from which a first mounting prong 234 extends rearwardly to engage a mounting hole in the pegboard support. Prong 234 is similar to prongs 34 and 134 and is formed as a generally hook-shaped element. A second mounting prong 235 is provided for product support bracket 220, however, with prong 235 being a straight prong that has an enlarged head 236 split by a channel 238. Prong 235 is oriented vertically below prong 234, as is shown in FIGS. 11 and 12, and a is spaced therefrom a distance equal to the vertical spacing of holes 14 in the pegboard display system. Thus, product support bracket 220 is mounted to pegboard support 12, shown in phantom in FIG. 12, by means of inserting prongs 234 and 235 through a pair of vertically spaced holes 14. A product support arm 230 extends forwardly of mounting base 234 and terminates in an outer end 232.

An information display bracket 240 is provided and is modified from the display brackets 40 and 140 described above. Information bracket 240 has a mounting plate 242 that has an upper portion 252 and a lower portion 254 which is split by a slot 258 into a pair of wings 260. The interior edge 259 of longitudinal slot 258 is arcuate and is sized to rest on prong 234 when lower portion 254 of mounting plate 242 is interposed between mounting base 224 and pegboard support 12. Again, spacer means in the form of nubs 266 maybe provided so that mounting plate 242 defines an inclined plane with respect to pegboard support 12. A display arm 244 extends from a distal end 248 and projects forwardly of mounting plate 242, and an information display plate 246 is mounted at the distal end of display arm 244, as described above.

In use, mounting plate 242 may simply be slid between pegboard 12 and mounting base 224 so that it snugly mounted there between with arcuate portion 259 engaging prong 234. If desired, slot 258 may have a width slightly narrower than the cross-section of prong 234 so that arcuate portion 259 positively locks onto prong 234 by making arcuate edge 259 have a radius of curvature slightly larger than prong 234, as described below with respect to FIG. 13. Wings 260 may then be slightly deflected apart to release prong 234 from slot 258 and arcuate cutout region 259.

Figure 13:
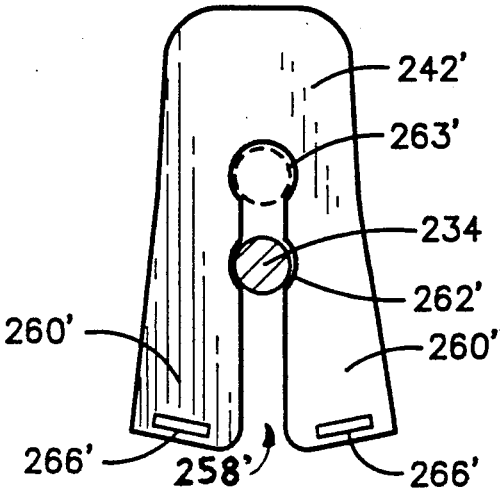

An alternate embodiment of the mounting plate for display bracket 240 is shown in FIG. 13. Here, mounting plate 242' has a slot 258' so that a pair of wings 260' are provided. Slot 258' has a slot width that is smaller than the diameter (width) of prong 234, and a pair of circular cutout regions 262' and 263' are provided. Circular cutout regions 262' and 263' have a diameter slightly larger than the diameter of prong 234 so that prong 234 will be positively engaged in a "snap-fit" manner selectively in either cutout region 262' and 263'. This provides for vertical adjustment of plate 242' with respect to mounting base 224 of product support bracket 220. Thus, the effective distance of spacing between display arm 242 and product support arm 230 can be varied.

Accordingly, the present invention has been described with some degree of particularity directed to the preferred embodiment of the present invention. It should be appreciated, though, that the present invention is defined by the following claims construed in light of the prior art so that modifications or changes maybe made to the preferred embodiment of the present invention without departing from the invention concepts contained herein.

I claim:

1. In a pegboard display system wherein an upright pegboard support has a plurality of mounting holes which extend through the pegboard support between front and rear surfaces thereof and wherein product support brackets are provided to mount on said pegboard support in order to display products, each said product support bracket including a mounting base, at least one prong adapted to extend through a selected mounting hole to fasten said product support bracket to said pegboard support and a product support arm connected to and projecting forwardly of said mounting base to terminate at a free outer end so that products may be received on said product support arm and displayed forwardly of said pegboard support when said product support bracket is fastened thereon with said mounting base supported against the front surface thereof, the improvement comprising an information display bracket including a mounting plate having an upper portion and a lower portion, a display arm having a proximal end connected to the upper portion of said mounting plate and projecting forwardly thereof to a distal end, and an information display plate connected to the distal end of said display arm, the lower portion of said mounting plate having a thickness permitting the lower portion of said mounting plate to be interposed between said mounting base and the front surface of said pegboard support when said product support bracket is fastened thereon, and wherein said mounting plate has engagement means for engaging said prong whereby said mounting plate is positively supported by and positioned with respect to the product support bracket such that said display arm is held in a spaced relation above said product support arm along the length thereof.

2. The improvement according to claim 1 wherein said display arm has a length sufficient to position said information display plate forwardly of the outer end of said product support arm.

3. The improvement according to claim 1 wherein said display plate has a point to attachment of the distal end of said display arm and a lower edge and wherein the distance between the distal end of said display arm and said product support arm is greater than a vertical length of said display plate measured between the point of attachment and said lower edge.

4. The improvement according to claim 1 wherein said display arm and said product arm are substantially parallel when said product support bracket and said information display bracket are mounted on said pegboard support surface.

5. The improvement according to claim 1 wherein the lower portion of said mounting plate includes spacer means for spacing said lower portion forward of the front surface whereby said mounting plate defines an inclined plane with respect to the front surface of said pegboard support.

6. The improvement according to claim 1 wherein said information display bracket is formed as an integral one-piece construction of plastic material.

7. The improvement according to claim 1 wherein said product support bracket has a pair of horizontal spaced prongs, said engagement means defined by a pair of outwardly disposed shoulders positioned to rest on said prongs.

8. The improvement according to claim 7 wherein said mounting plate has opposite outer side edges which are convergent along the lower portion thereof.

9. The improvement according to claim 7 wherein said mounting plate has a longitudinal slot generally perpendicular to a line defined by said outwardly disposed shoulders whereby the lower portion of said mounting plate is separated by the slot into a pair of wings, said shoulders each formed by an arcuate portion of a semi-circular cutout region on an outer side edge of a respective wing whereby the cutout regions releasably lock onto said prongs when said shoulders engage said prongs, said cutout regions releasing said prongs when said wings are forced together.

10. The improvement according to claim 9 wherein the mounting base of said product display bracket includes a vertically oriented rod portion located between said prongs, and wherein the slot in said mounting plate is sized and oriented to receive said rod portion.

11. The improvement according to claim 7 wherein said engagement means includes a plurality of pairs of outwardly disposed shoulders vertically spaced from one another whereby the spacing between said product support arm and said display arm may be selectively varied.

12. The improvement according to claim 1 where said mounting plate has a slot formed partially through the longitudinal length thereof such that said slot has an entryway and an interior arcuate edge whereby the lower portion of said mounting plate is separated into a pair of parallel wings, said engagement means defined by the interior arcuate edge of the slot.

13. The improvement according to claim 12 wherein said slot terminates in a semi-circular cutout region sized to receive said prong, said slot having a slot width smaller than the width of said prong whereby the cutout region releasably locks onto said prong when the cutout regions engages said prong, said cutout region releasing said prong when said wings are forced apart.

14. The improvement according to claim 13 wherein said engagement means is defined by a plurality of semi-circular cutout regions spaced from one another along the slot whereby the spacing between said product support arm and said display arm may be selectively varied.

* * * * *